US009400488B2

(12) United States Patent
Marechal et al.

(10) Patent No.: US 9,400,488 B2
(45) Date of Patent: Jul. 26, 2016

(54) MECHANICAL WINDING DEVICE FOR A WATCH

(71) Applicant: Montres Breguet S.A., L'Abbaye (CH)

(72) Inventors: Sylvain Marechal, Bois-d'Amont (FR); Benoit Junod, Les Rousses (FR)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 14/937,996

(22) Filed: Nov. 11, 2015

(65) Prior Publication Data

US 2016/0170373 A1 Jun. 16, 2016

(30) Foreign Application Priority Data

Dec. 10, 2014 (EP) ..... 14197193

(51) Int. Cl.
*G04B 5/06* (2006.01)
*G04B 5/18* (2006.01)

(52) U.S. Cl.
CPC . *G04B 5/06* (2013.01); *G04B 5/188* (2013.01)

(58) Field of Classification Search
CPC ..... G04B 5/00; G04B 5/02; G04B 5/04; G04B 5/06; G04B 5/16; G04B 5/185; G04B 5/188
See application file for complete search history.

(56) References Cited

U.S. PATENT DOCUMENTS 2,988,869 A * 6/1961 Hans ..... G04B 5/19 368/208
3,019,595 A 2/1962 Murrle
3,628,326 A * 12/1971 Polo ..... G04B 5/02 368/208
6,021,098 A 2/2000 Rebeaud
6,409,379 B1 * 6/2002 Gabathuler ..... G04B 5/14 368/150
7,547,136 B2 * 6/2009 Bravo ..... G04B 5/165 310/36

FOREIGN PATENT DOCUMENTS

| | | |
|---|---|---|
| CH | 460 639 | 9/1968 |
| CH | 516 829 | 8/1971 |
| EP | 1 134 626 A1 | 9/2001 |
| FR | 1 145 972 | 11/1957 |

OTHER PUBLICATIONS

European Search Report issued Aug. 21, 2015 in European Application 14197193, filed on Dec. 10, 2014 ( with English Translation).

* cited by examiner

*Primary Examiner* — Vit W Miska
(74) *Attorney, Agent, or Firm* — Oblon, McClelland, Maier & Neustadt, L.L.P.

(57) ABSTRACT

An automatic winding device for a spring of a watch movement including a weight fixed on a support via a bearing including a ring which drives, in only one direction of rotation called the winding direction, a transmission gear in order to wind the mainspring, this winding device wherein, on the one hand, the bearing is of the one-way type and blocks the rotation of the weight in the opposite direction to the winding direction, called the blocking direction and wherein, on the other hand, the device includes a means for decoupling the weight from said bearing in at least the blocking direction when the weight exerts on the bearing a torque higher than a desired value.

13 Claims, 5 Drawing Sheets

MECHANICAL WINDING DEVICE FOR A WATCH

This application claims priority from European Patent Application No. 14197193.7 filed Dec. 10, 2014, the entire disclosure of which is hereby incorporated herein by reference.

The invention relates to an automatic winding device of a means for driving a timepiece movement.

Watch movements require drive means to supply energy to a set of mechanisms used for providing at least one time indication.

In electronic watches, these means comprise a battery which powers either electro-optical display means, or one or more electric motors for driving analogue display members.

In mechanical watches, this is a mainspring or spring inside a barrel which is wound under the action of a manually actuated winding mechanism or by the movements of the user which are transmitted to the mainspring via an oscillating weight connected to a reduction gear train. The invention relates to watch movements with automatic winding using an oscillating weight.

The oscillating weight may, depending on the mechanism with which it is associated, either wind the spring using the energy that the weight produces in only one direction of rotation, or in both directions of rotation.

To benefit from the energy in both directions of rotation of the weight, it is known, from CH Patent Application No 694025, to use two one-way bearings associated with the ball bearing of the oscillating weight. These two bearings are mounted head-to-tail to form a reverser. Thus, whatever its direction of rotation, the weight winds the mainspring. The energy from the weight is thus always dissipated in winding the spring.

The invention is intended, in particular, for automatic winding mechanisms whose oscillating weight winds the spring in only one direction of rotation.

Let us recall that in this type of mechanism the oscillating weight is mounted and rotatably guided on an arbor with an unbalance. When the oscillating weight moves in a first direction of rotation, called the winding direction, it drives a transmission gear train which winds a mainspring. When the movement of the weight occurs in the other direction, called the free direction, the oscillating weight no longer acts on the transmission train of the spring, and it rotates freely. In the absence of any movement by the user, the weight is returned to its point of equilibrium by the unbalance after several oscillations that have enabled the weight to wind the spring each time that it moved in the winding direction.

The oscillating weight is generally suspended above the movement by means of a ball bearing comprising an outer ring, a core or inner ring, between which is arranged a ball bearing cage, with a screw securing the inner ring to the movement.

The arm movement of the person wearing the watch may cause rotation in either direction of rotation of the weight. With one-way winding systems, the energy is recovered in only one of the two directions of rotation of the oscillating weight.

When the oscillating weight rotates in the winding direction, the transmission gear train which ensures the winding operation meshes with the outer ring of the bearing. Since the weight then drives a gear train, its speed of rotation is slowed relative to its speed of rotation in the free direction. The rolling noise in the winding direction is thus relatively low. However, in the free direction, the weight rotates at a higher speed which produces an increased rolling noise, which is undesirable especially for high-end watches.

The problem is therefore to reduce the noise when the oscillating weight moves in the opposite direction to the winding direction.

It is therefore a main object of the invention to overcome the aforementioned drawbacks in addition to others by providing an automatic winding device which can limit noise during the rotation of the weight in the free direction while ensuring that the weight operates reliably even in the event of shocks.

To this end, the invention concerns an automatic winding device for a mainspring of a watch movement including a weight fixed on a support via at least one bearing comprising a ring which drives, in only one direction of rotation called the winding direction, a transmission gear in order to wind the mainspring, this winding device being characterized in that, on the one hand, the bearing is of the one-way type and blocks the rotation of the weight in the opposite direction to the winding direction, called the blocking direction and in that, on the other hand, the device includes means for decoupling the weight from said bearing in at least the blocking direction when the weight exerts on the bearing a torque higher than a desired value to allow the weight to rotate in at least the blocking direction.

As a result of these features, the weight now rotates in only one direction, namely the winding direction, so that any noise related to rotation in the free direction, now the blocking direction, is eliminated. However, if significant force is exerted by the weight in the blocking direction, for example in the event of a shock, rotation of the weight is nonetheless made possible to prevent high stresses causing damage to the bearing.

Other characteristics and advantages of the invention will appear more clearly upon reading the following description of example embodiments, said description being given by way of non-limiting example with reference to the appended drawings, among which:

Figure 1:
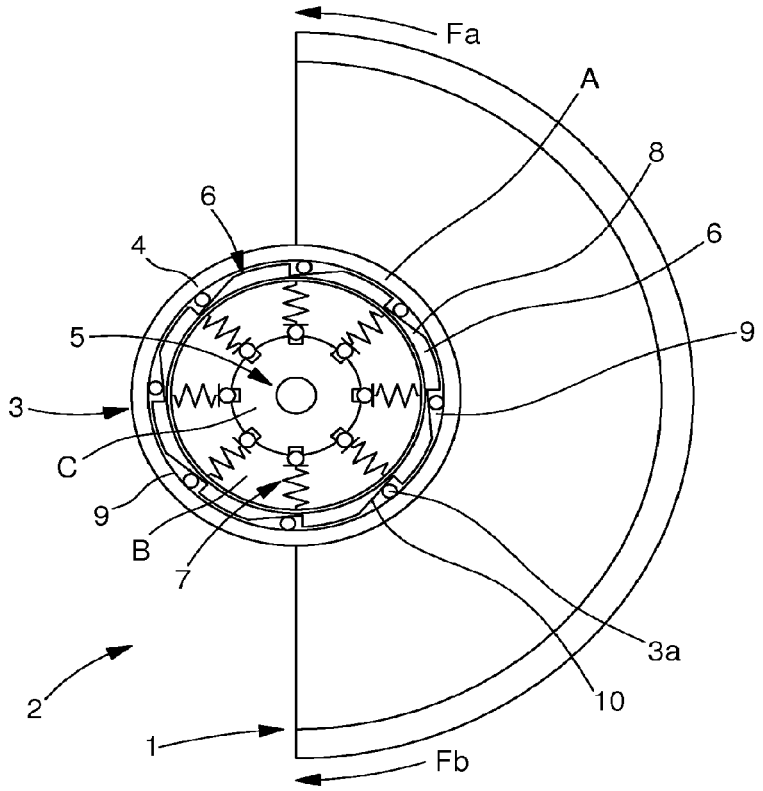
FIG. 1 is a schematic diagram of a mechanical winding device according to a first embodiment of the invention.
Figure 3A:
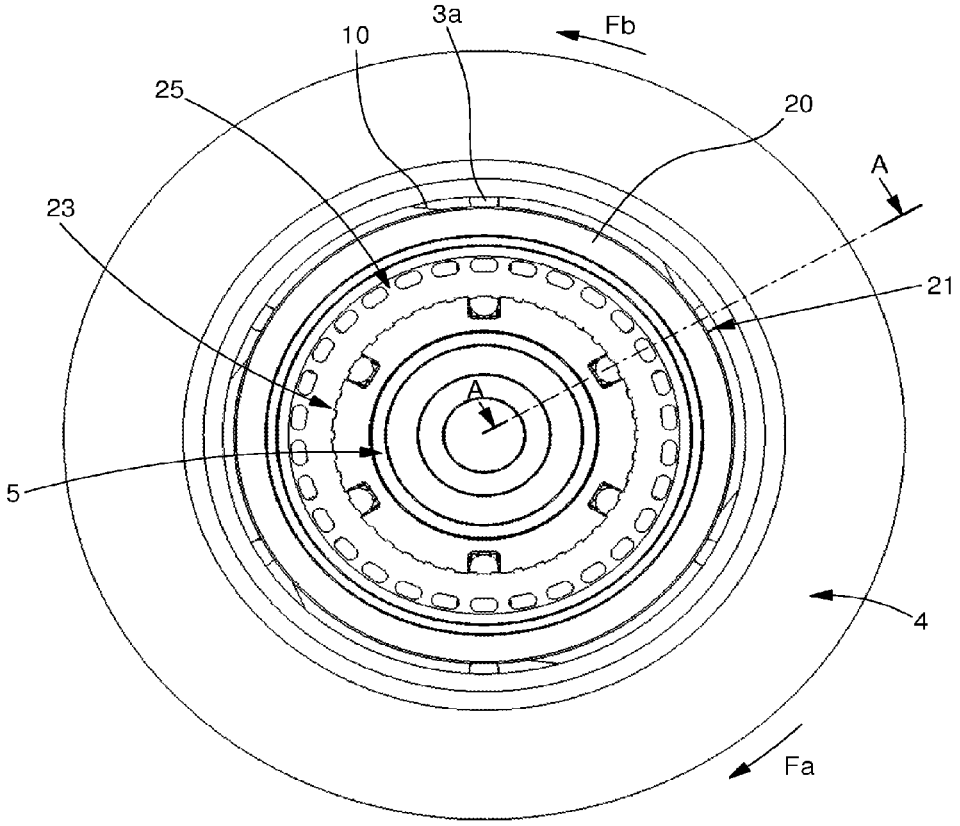
Figure 3B:
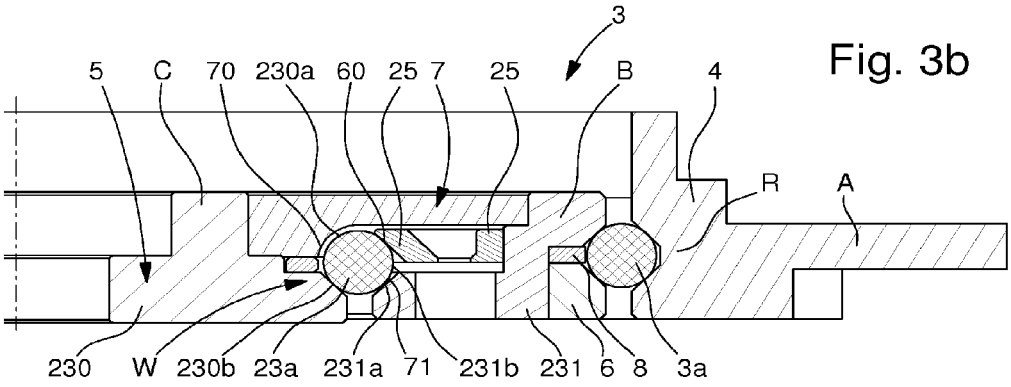

FIGS. 3*a* and 3*b* show a first example application of the principle illustrated in FIG. 1, respectively in a front view and a sectional view along the line A-A of the Figure.

Figure 4A:
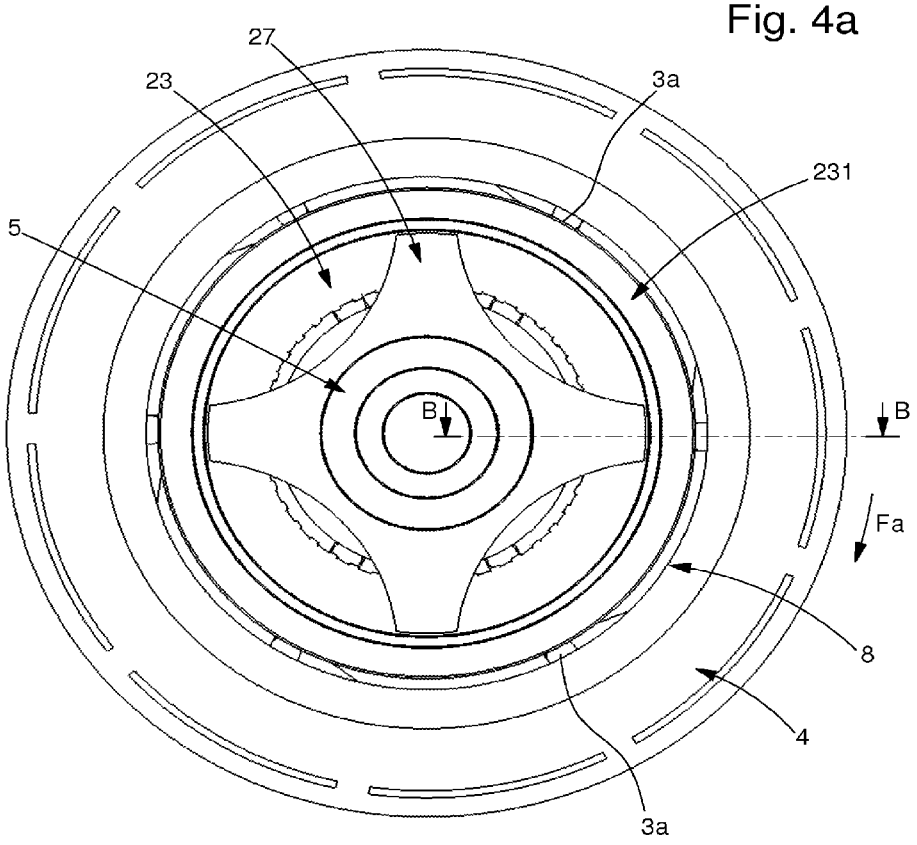
Figure 4B:
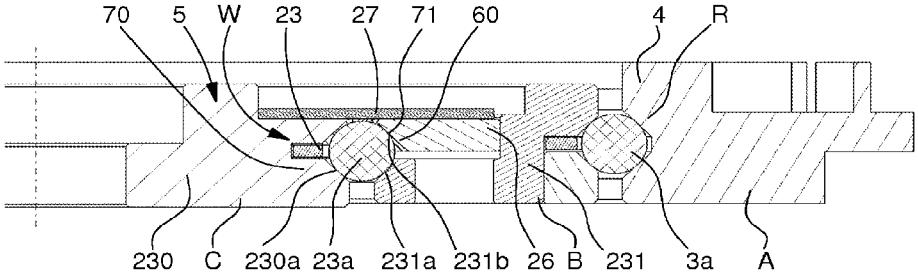

FIGS. 4*a* and 4*b* show a second example application of the principle illustrated in FIG. 1, respectively in a front view and a sectional view along the line B-B of the Figure.

Figure 2:
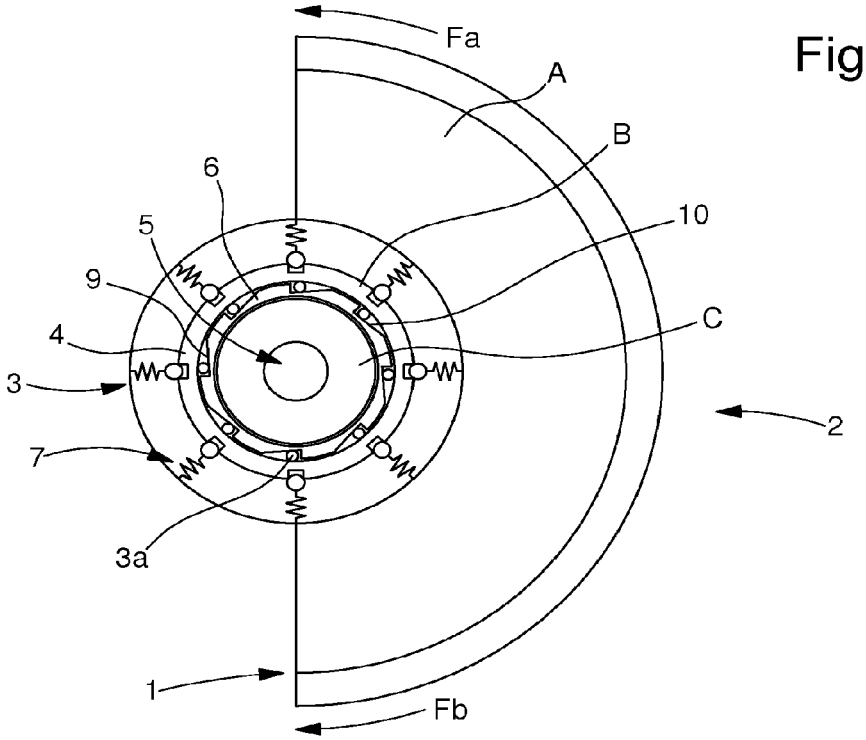
FIG. 2 is a schematic diagram of a mechanical winding device according to a second embodiment of the invention.
Figure 5A:
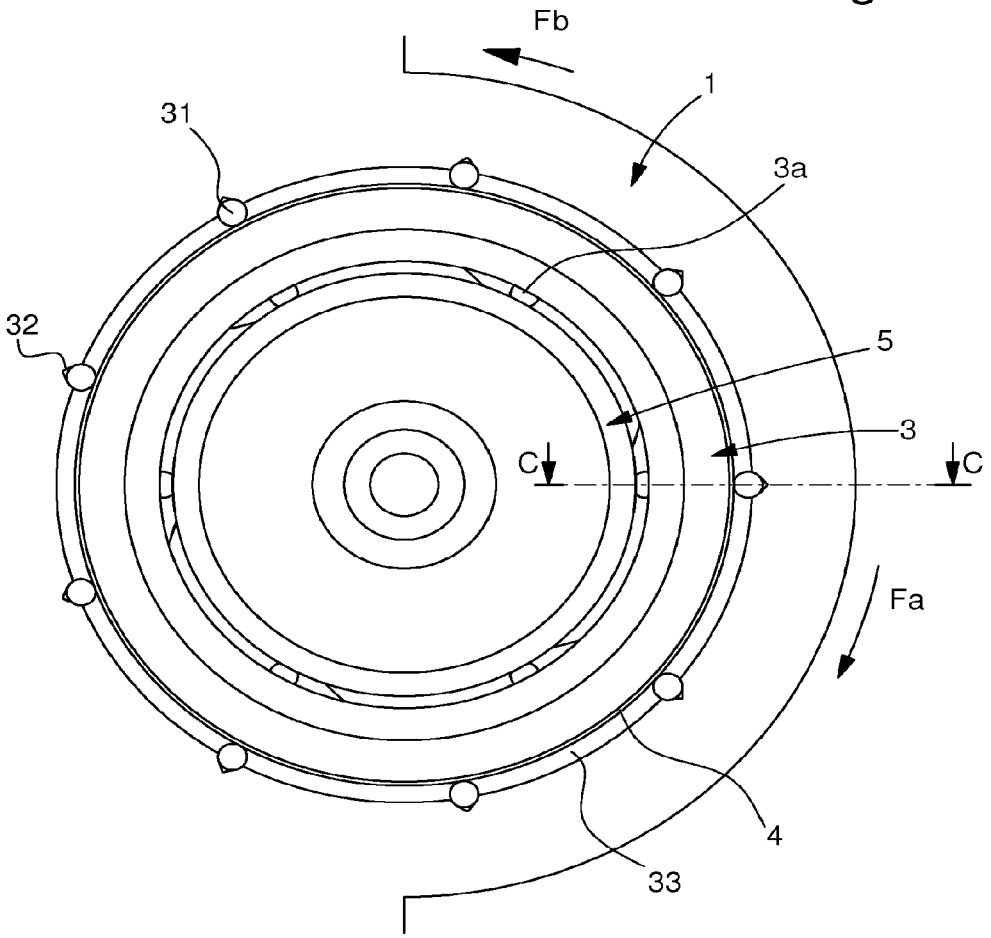
Figure 5B:
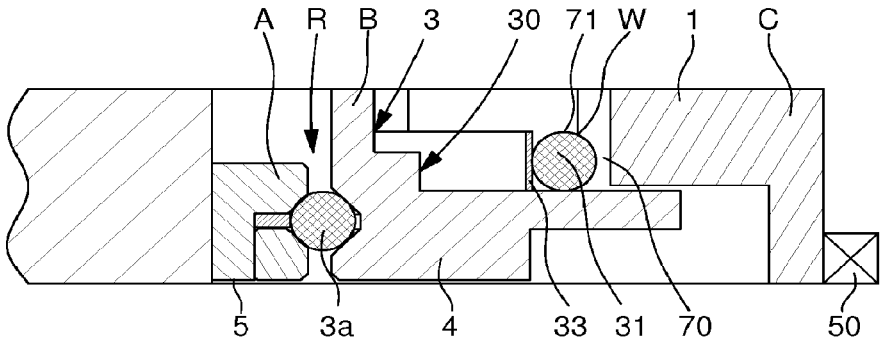

FIGS. 5*a* and 5*b* illustrate the principle shown in FIG. 2, in a front view and a sectional view along the line C-C of the Figure.

Figure 6A:
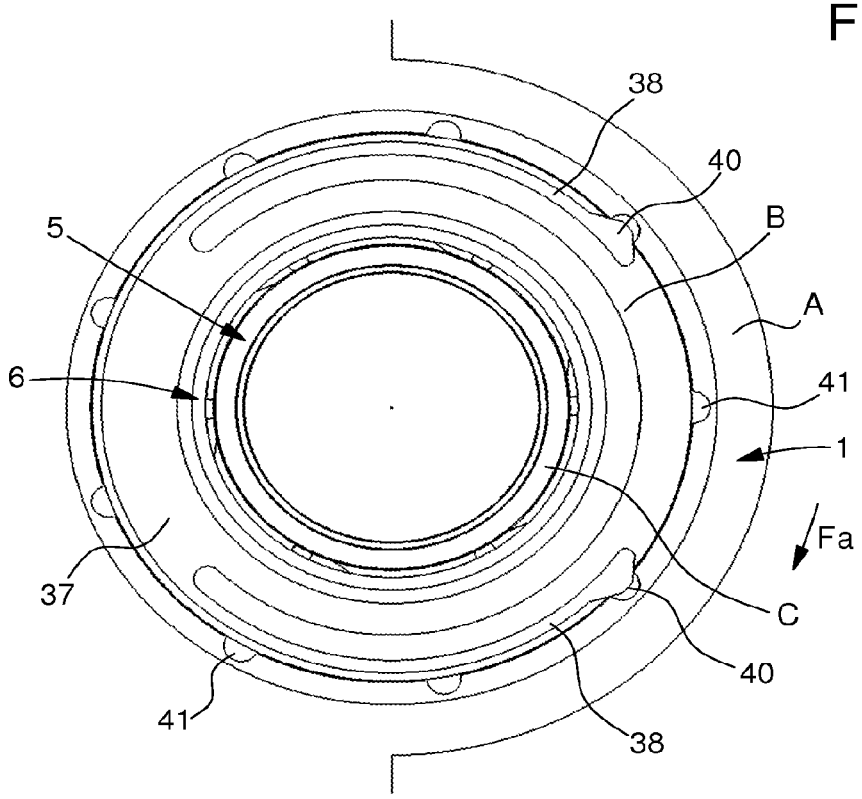
Figure 6B:
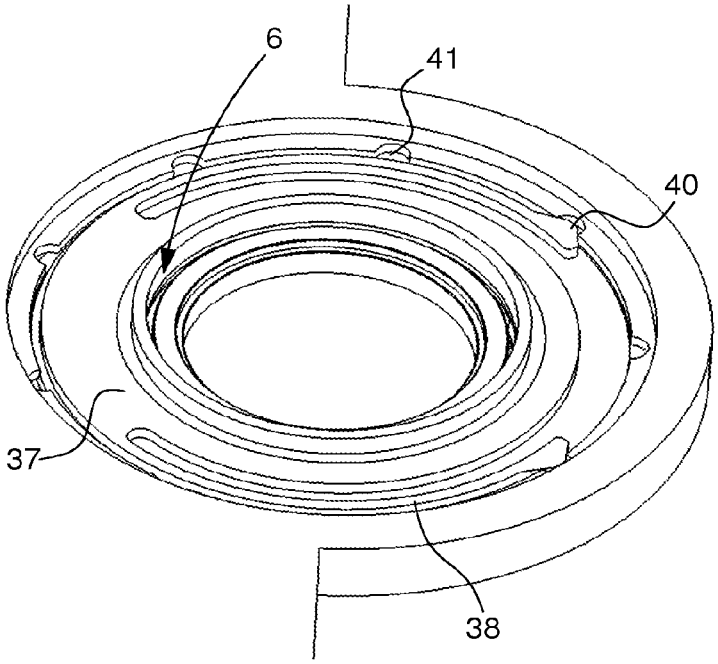

FIGS. 6*a* and 6*b* illustrate the principle shown in FIG. 2 in a front view and a perspective view.

Referring to the drawings, there is shown a weight 1 intended for an automatic winding device of a mainspring of a watch movement.

This device 2 includes a weight 1 rotatably secured on a support formed, for example, by the main plate of the watch movement by means of a bearing 3. Typically, weight 1 is rotatably suspended above the back of the watch movement by means of bearing 3. Bearing 3 includes an outer ring 4 which drives, in a single direction of rotation, called the winding direction, represented by arrow Fa in the FIGS. 1 and 2), a transmission gear train or reduction gear train (not shown) to transmit the rotational motion of oscillating weight 1 to the barrel ratchet (not shown) and to wind the mainspring (not shown). Bearing 3 further includes a core or inner ring 5, a plurality of balls 3*a* arranged in a cage 6 disposed between outer ring 4 and core 5.

According to a feature of this winding device, bearing 3 is of the one-way type and blocks the rotation of the weight in the opposite direction to the winding direction, called the blocking direction Fb. Further, the device includes a means 7 for decoupling weight 1 from bearing 3 in at least blocking direction Fb when weight 1 exerts a torque higher than a desired value on the ring integral with weight 1, in order to allow the weight to rotate in at least the blocking direction.

This arrangement therefore only allows weight 1 to rotate in winding direction Fa. Consequently the noise made by the weight when it moves in the blocking direction (which previously allowed free rotation) is eliminated. However this solution causes a problem since the weight is set in rotation by the arm movement of the person wearing the watch and when this movement causes the weight to move in blocking direction Fb and the energy produced by this movement is too great, the energy must be partially dissipated, otherwise there is a risk of damage to bearing 3. Consequently, when this energy exceeds a determined threshold, weight 1 can nonetheless move in blocking direction Fb.

Means 7 for decoupling the core or inner ring 5 from the outer ring via cage 6 avoids such damage since, beyond a threshold, the energy accumulated by weight 1 can be dissipated by the relative rotation of core 5 with respect to outer ring 4 in the blocking direction of weight 1.

Thus, it is observed that core 5 is blocked in rotation with respect to the support, ball cage 6 is devised to allow outer ring 4 free rotation with respect to core 5 when it rotates in winding direction Fa and to block the rotation of outer ring 4 in the opposite direction of rotation, called the blocking direction (represented by arrow Fb in FIGS. 1 and 2).

Blocking the rotation in the blocking direction means that outer ring 4 meshes with core 5 via balls 3*a* and since core 5 is joined to the support, weight 1 is therefore immobilised in that direction.

Weight 1 rotates in only one direction (anticlockwise in FIGS. 1 and 2) and therefore makes no noise in the other direction.

For FIGS. 3 to 6 the winding direction is a clockwise rotation.

One-way bearings can be used to achieve blocking. The principle of such bearings is described in CH Patent No 694025 which is incorporated herein by reference.

In such a one-way bearing, cage 6 is formed of a ring 8 with notches 9 on the periphery thereof. These notches have a slightly greater depth than that of balls 3*a* to accommodate the entire depth of each ball 3*a*. These notches 9 each extend in the plane of the bearing via a ramp 10 which is inclined with respect to a line tangent to ring 9 and rises towards the periphery of the latter so that (clockwise here in FIGS. 1 and 2) ball 3*a* forms a canting between the two rings in one of the two directions of rotation.

Decoupling means 7 can be mounted between core 5 and outer ring 4 (FIGS. 1, 3 and 4) or between weight 1 and bearing 3 (FIGS. 2, 5 and 6) that is to say the outer ring.

This decoupling means is intended to protect against strong accelerations in the event of a shock (for example: the force developed by a tennis player making a serve).

The desired value of the torque is determined by friction forces or elastic forces.

In the invention, this one-way bearing 3 is modified to incorporate a decoupling means 7 to prevent adverse effects when weight 1 is subjected to a strong impulse (shock) tending to rotate the weight in blocking direction Fb.

To this end, the bearing includes a decoupling means 7 to at least indirectly decouple oscillating weight 1 from core 5 in the blocking direction when the weight exerts a torque higher than desired value.

The automatic winding device includes a "two-stage" bearing formed by at least three concentrically mounted rings A, B, C with, on the one hand, between two rings (A and B in FIG. 1 and B and C in FIG. 2) a connection R for one-way rotation allowing the weight to rotate in only one direction, the winding direction, and, on the other hand, between two other rings (B and C in FIG. 1 and B and A in FIG. 2) a decoupling connection W in response to a force higher than desired value.

This uncouplable connection W is therefore, in one embodiment (FIGS. 3*a*, 3*b*), formed of rolling elements such as balls 23*a*, or rollers between two tracks, one of the tracks having cavities 70, the other track also having elastically deformable cavities 71 to allow the rolling elements to leave their cavities and permit rotation in the usual blocking direction.

In the case of FIG. 1, decoupling means 7 only acts in the blocking direction (anticlockwise). Means 7 is disposed between cage 6 and core 5.

However, in the case of FIG. 2, the decoupling means acts in both directions of rotation. Employing decoupling means 7 in the blocking direction may be useful when the spring is completely wound. This device allows a mainspring bridle to be used in place of a slip-spring in movements with automatic winding.

Various solutions have been illustrated.

Decoupling means 7 thus includes rolling elements such as balls forming a mechanical connection with two concentric rings (C and B in FIG. 1 or A and B in FIG. 2) each having a means 70, 71 for retaining a fraction of the rolling element, the retaining means 71 of one of the rings becoming inoperative beyond a resistant torque that exceeds a desired value. Each ball cooperates with two retaining means 70, 71, one of which 70 belongs to one ring (C in FIGS. 3*b* and 4*b*) and the other 71 to another ring (B in FIGS. 3*b*, 4*b*) so that the rotation of one bearing drives the other bearing. When the retaining means of one of the rings are, for example, modified by deformation, the rolling elements no longer drive one of the rings (cavities 71 deform).

FIGS. 3*a* and 3*b* show a front view and a sectional view of a solution according to the arrangement of FIG. 1.

Between core 5 and one-way bearing 3, the device includes balls 23*a* capable of moving in a ball bearing cage 23. Cage 23 is formed of one portion 230 integral in rotation with core 5 and another complementary portion 231 integral in rotation with bearing 3. Balls 23*a* form a mechanical connection between complementary portions 230 and 231 of the cage. This cage has four guide faces 230*a*, 230*b*, 231*a*, 231*b* forming a tunnel. Balls 23*a* are held apart from each other in the cage by means of notches 60. One 231*b* of the guide faces of the cage can move sideways to release balls 23*a* from the notches and thereby separate the two portions 230, 231 of the cage and allow bearing 3 to rotatably slide with respect to core 5 in the blocking direction.

To achieve this, ball bearing cage 23, which has 4 guide faces 230*a*, 230*b*, 231*a*, 231*b* forming a tunnel, has one face 231*b* that can move to temporarily increase the section of the tunnel. Faces 230*a* and 230*b* form the cavities 70 or retaining means 70, and faces 231*a* and 231*b* form the deformable cavities 71.

According to the solution of FIG. 3*a* or 3*b*, guide face 231*b* which moves apart is embodied by an elastic strip 25 shown in a coupled position in FIG. 3.

The decoupled position is not shown, but in the sectional view, the left end of spring 25 needs only to be moved upwards to enable the ball to roll.

In FIG. 4*a* or 4*b*, the solution differs from that of FIG. 3 in that the guide face 231*b* which moves apart is formed by a solid part 26 held in position by an elastic strip 27 known as a 'metal foil'.

As will be understood, when the torque between portion 230 and portion 231 of the cage is greater than that set by the elastic effect of strips 25 or 27, the resultant of the force between core 5 and bearing 3 forces balls 23*a* to pass over a notch, moving one 231*b* of the guide faces sideways, which allows a slidable rotation of portions 230 and 231 of the cage relative to each other. The notches in the guide faces determine singular positions.

Forces tend to move movable face 231*b* sideways.

FIG. 5*a* or 5*b* shows a technical solution according to FIG. 2.

Decoupling means 7 includes a set of balls 31 accommodated inside a ball 31 spacer 30 located between one-way bearing 3 and the weight. Balls 31 are stressed by a spring 33 developing a radial thrust which holds them in radial cavities 32 provided in an inner cylindrical shoulder 1*a* of weight 1 or in an inner cylindrical shoulder of a ring integral with weight 1.

The forces (greater than a desired value) induced by weight 1 trying to move in the blocking direction causes the balls to push on spring 33 which allows the balls to leave their cavities 32 and thus the weight to rotate independently of bearing 3.

The oscillating weight is guided in rotation by external bearings 50.

FIG. 6 is similar to that of FIG. 5, there is seen again the inner ring or core 5, outer ring 4 concentric to the inner ring with its cage 6 for ball bearings 3*a*.

Decoupling means 7 is a spring means 37 housed in a circular groove and mounted in rotation with bearing 3; said spring means includes at least one elastic tongue 38 radially abutting at least indirectly weight 1, the tongue having a radial friction surface along its length (face turned outwards).

The elastic tongue may include a shape 40 at the end thereof that lodges inside a notch 41 which completes the friction effect. In FIG. 6*a* two opposite tongues 38 are provided.

In the case of FIGS. 5 and 6 the forces that are exerted to form a decoupling connection are radial forces, whereas in the case of FIGS. 3 and 4 they are forces orthogonal to the plane of rotation of the weight.

There is thus incorporated in the one-way bearing, a compact 'coupling/decoupling' device wherein all of the components may be likened to a one-way bearing with a safety mechanism.

What is claimed is:

1. An automatic winding device for a spring of a watch movement including a weight fixed on a support via a bearing comprising a ring which drives, in only one direction of rotation called the winding direction, a transmission gear in order to wind the spring, wherein the bearing is a one-way bearing and blocks the rotation of the weight in the opposite direction to the winding direction, called the blocking direction and wherein, the device includes a decoupling mechanism configured to decouple the weight from said bearing in at least the blocking direction when the weight exerts on the bearing a torque higher than a desired value.

2. The automatic winding device according to claim 1, wherein the decoupling mechanism is mounted between the core and the outer ring, the weight being mounted integral with the outer ring.

3. The automatic winding device according to claim 1, wherein the decoupling mechanism is mounted between an oscillating weight and the outer ring.

4. The automatic winding device according to claim 1, wherein the desired value is set by an elastic means and/or a friction means.

5. The automatic winding device according to claim 1, wherein the device includes a two-stage bearing formed by at least three concentrically mounted rings, said rings being arranged so that between two rings, a connection for one-way rotation only allows the weight to rotate in the winding direction and, further arranged so that a decoupling connection in response to a force greater than a desired value is formed between two other rings.

6. The automatic winding device according to claim 2, wherein the decoupling mechanism includes rolling elements forming a mechanical connection with two concentric rings each having a device for retaining a fraction of the rolling element and the retaining device of one of the rings becomes inoperative beyond a resistant torque that exceeds a desired value.

7. The automatic winding device according to claim 6, wherein between the core and the one-way bearing, the device includes balls capable of moving in a ball bearing cage formed of one portion integral in rotation with the core and another portion integral in rotation with the bearing, the balls forming a mechanical connection between the complementary portions of the cage, wherein said cage has four guide faces forming a tunnel in which the balls are arranged, wherein one of the guide faces of the cage is movable in order to release the balls and thereby separate the two portions of the cage and allow the bearing to rotatably slide with respect to the core in the blocking direction.

8. The automatic winding device according to claim 7, wherein the guide face which moves apart is formed of an elastic strip.

9. The automatic winding device according to claim 7, wherein the guide face which moves apart is formed of a solid part held in position by a spring known as a 'metal foil'.

10. The automatic winding device according to claim 6, wherein the decoupling mechanism includes a set of balls housed in a ball spacer located between the one-way bearing and the weight, the balls being stressed by a spring developing a radial thrust which holds the balls in radial cavities.

11. The automatic winding device according to claim 4, wherein the decoupling mechanism is a spring device housed in a circular groove and mounted in rotation with the bearing, said spring device includes at least one elastic tongue radially abutting at least indirectly the weight, the tongue having a friction surface.

12. The automatic winding device according to claim 11, wherein the elastic tongue includes a shape at the end thereof that lodges inside a notch which completes a friction effect of the friction surface.

13. A timepiece movement, wherein the movement includes an automatic winding device for a spring of a watch movement including a weight fixed on a support via a bearing comprising a ring which drives, in only one direction of rotation called the winding direction, a transmission gear in order to wind the spring, wherein the bearing is a one-way bearing and blocks the rotation of the weight in the opposite direction to the winding direction, called the blocking direction and wherein the device includes a decoupling mechanism configured to decouple the weight from said bearing in at least the blocking direction when the weight exerts on the bearing a torque higher than a desired value.

* * * * *